United States Patent [19]

Eberhart et al.

[11] Patent Number: 4,685,259

[45] Date of Patent: Aug. 11, 1987

[54] SOUND RATED FLOOR SYSTEM AND METHOD OF CONSTRUCTING SAME

[75] Inventors: Laurence L. Eberhart; Larry B. Holben, both of Dublin, Ohio

[73] Assignee: Peabody Noise Control, Inc., Dublin, Ohio

[21] Appl. No.: 829,835

[22] Filed: Feb. 14, 1986

[51] Int. Cl.[4] ..... E04B 1/82; E04F 13/08

[52] U.S. Cl. ..... 52/144; 52/384; 52/612

[58] Field of Search ..... 52/384, 144, 145, 612, 52/346, 785, 805, 807

[56] References Cited

U.S. PATENT DOCUMENTS

| | | | |
|---|---|---|---|
| 1,721,861 | 7/1929 | Oden | 52/612 |
| 2,174,581 | 10/1939 | Hoge | 52/612 |
| 2,910,396 | 10/1959 | Randall et al. | 52/576 |
| 4,023,617 | 5/1977 | Carlson et al. | 52/144 |
| 4,522,284 | 6/1985 | Fearon | 428/117 |

FOREIGN PATENT DOCUMENTS

| | | | |
|---|---|---|---|
| 1010612 | 9/1952 | France | 52/806 |
| 67626 | 3/1944 | Norway | 52/612 |
| 556460 | 10/1943 | United Kingdom | 52/807 |

*Primary Examiner*—James L. Ridgill, Jr.

*Attorney, Agent, or Firm*—St. Onge Steward Johnston & Reens

[57] ABSTRACT

A sound rated flooring is provided comprising a sound attenuation layer having a composite panel structure having a core and at least one acoustically semi-transparent facing of fibrous material bonded to the core and a rigid layer positioned on the sound attenuation layer. A moisture inhibiting barrier may be positioned between the composite panel structure and the rigid layer. A method for constructing a sound rated floor is also provided, comprising the steps of positioning the composite panel structure described herein over a substantially horizontal base surface and then positioning the rigid layer over the composite panel structure. The finished covering is then placed over the rigid layer.

29 Claims, 5 Drawing Figures

SOUND RATED FLOOR SYSTEM AND METHOD OF CONSTRUCTING SAME

BACKGROUND OF THE INVENTION (1) Field of the Invention

The present invention relates to an improved sound rated floor system and a method for constructing same, and more particularly to a novel structure for a sound rated floor comprising an attenuation layer having acoustically semi-transparent first and second facings bonded to a core and a rigid layer positioned above the attenuation layer. Also disclosed is a method for constructing a sound rated floor using such an attenuation layer.

(2) Description of the Prior Art

Sound rated or floating floor systems are known in the prior art for acoustically isolating a room beneath a floor on which impacts may occur, such as pedestrian footfalls, sports activities, dropping of toys, or scraping of furniture being moved.

Impact noise generation can generally be reduced by using thick carpeting, but where concrete, tile, or hardwood finishes are to be used a sound rated floor may be particularly desirable. The transmission of impact noise to the area below can be reduced by resiliently supporting the floor away from the floor substructure, which typically transmits the noise into the area below. If the floor surface receiving the impact is isolated from the substructure, then the impact sound transmission will be greatly reduced. Likewise, if the ceiling below is isolated from the substructure, the impact sound will be restricted from traveling into the area below.

Sound rated floors are typically evaluated by ASTM Standards E90 or #336 and #492 and are rated as to impact insulation class (IIC). The greater the IIC rating, the less impact noise will be transmitted to the area below. Floors may also be rated as to Sound Transmission Class (STC). The greater the STC rating, the less airborne sound will be transmitted to the area below. Sound rated floors typically are specified to have an IIC rating of not less than 50 and an STC rating of not less than 50. Even though an IIC rating of 50 meets many building codes, experience has shown that in luxury condominium applications even floor-ceiling systems having an IIC of 56–57 may not be acceptable because some impact noise is still audible.

In addition to having an adequate STC and IIC rating, an acceptable sound rated floor must also have a relatively low profile. Low profile is important in order to maintain minimum transition height between a finished sound rated floor and adjacent areas, such as carpeted floors, which ordinarily do not need the sound rated construction.

Also, a sound rated floor must exhibit enough vertical stiffness to reduce cracking, creaking, and deflection of the finished covering. At the same time, the sound rated floor must be resilient enough to isolate the impact noise from the area to be protected below.

Two isolation media currently used and also approved by the Ceramic Tile Institute for sound rated tile floors are (i) 0.4 inch Enkasonic matting (nylon and carbon black spinerette extruded 630 g/sq. meter) and (ii) 0.25 inch Dow Ethafoam (polyethylene foam 2.7 pcf). While both of these systems are statically relatively soft and provide some degree of resiliency for impact insulation, the added effect of air stiffness in the 0.25 and 0.40 inch thick media makes the system very stiff dynamically and limits the amount of impact insulation. Because the systems are statically soft, they do not provide a high degree of support for the finished floor, and a relatively thick (7/16 inch) glass mesh mortar board, such as a product called Wonderboard, is used on top of the media to provide rigidity for preventing grout, tiles, and other finished flooring from cracking. Alternatively, a relatively thick ($1\frac{1}{4}$ inch) reinforced mortar bed must be installed on top of the resilient mat.

SUMMARY OF THE INVENTION

In accordance with the present invention, a sound rated floor for resting on a subflooring and supporting a finished covering is provided, said sound rated floor comprising a sound attenuation layer having a core and at least one acoustically semi-transparent first facing bonded to the core and a rigid layer positioned on the sound attenuation layer for supporting the finished flooring.

Also provided are moisture inhibiting layers for positioning between the subflooring and the sound attenuation layer, or between the sound attenuation layer and the rigid layer for inhibiting the passage of moisture therethrough.

In a particularly preferred embodiment, the attenuation layer comprises a paper honeycomb core having cells open to a first and second side thereof, and first and second facings of fiberglass are bonded to the first and second sides of the core, respectively. Such an attenuation layer is manufactured and sold as a composite panel structure by Peabody Noise Control, Inc., Dublin, Ohio. The rigid layer comprises glass reinforced concrete boards, a reinforced mortar bed, or wood surface such as plywood.

The Peabody composite panel structure preferred for the present invention has a nominal thickness of $\frac{5}{8}$ inch. The high compressive strength and static stiffness of this panel structure permits use of a thinner ($\frac{1}{4}$ inch thick) glass reinforced concrete (GRC) board such as Sterling Board by Cem-Fil Corporation, Flex-board by Johns-Manville Co., and Ultra-Board Regular by Brit-Am Venture Marketing Limited to provide rigidity and to provide minimum elevation transition from floating to non-floating floor areas.

It is an object of the present invention to provide a sound rated floor system that adequately supports the finishing covering while effectively attenuating incident impact noise.

It is a further object of the present invention to provide a sound rated floor system having a reduced elevation transition.

A further object of the present invention is to provide a sound rated floor having an attenuation layer which is relatively stiff to imposed static loads to prevent cracking of overlying grout and tile, but which is relatively soft when exposed to dynamic or impact loads to dissipate impact noise within the structure of the attenuation layer.

It is a further object of the present invention to provide a method for constructing a sound rated floor system.

Additional advantages of the sound rated floor system of the present invention and method for making same will be apparent from the brief description of the drawings and the detailed description of the preferred embodiment below.

DETAILED DESCRIPTION OF THE PREFERRED EMBODIMENT

Figure 1:
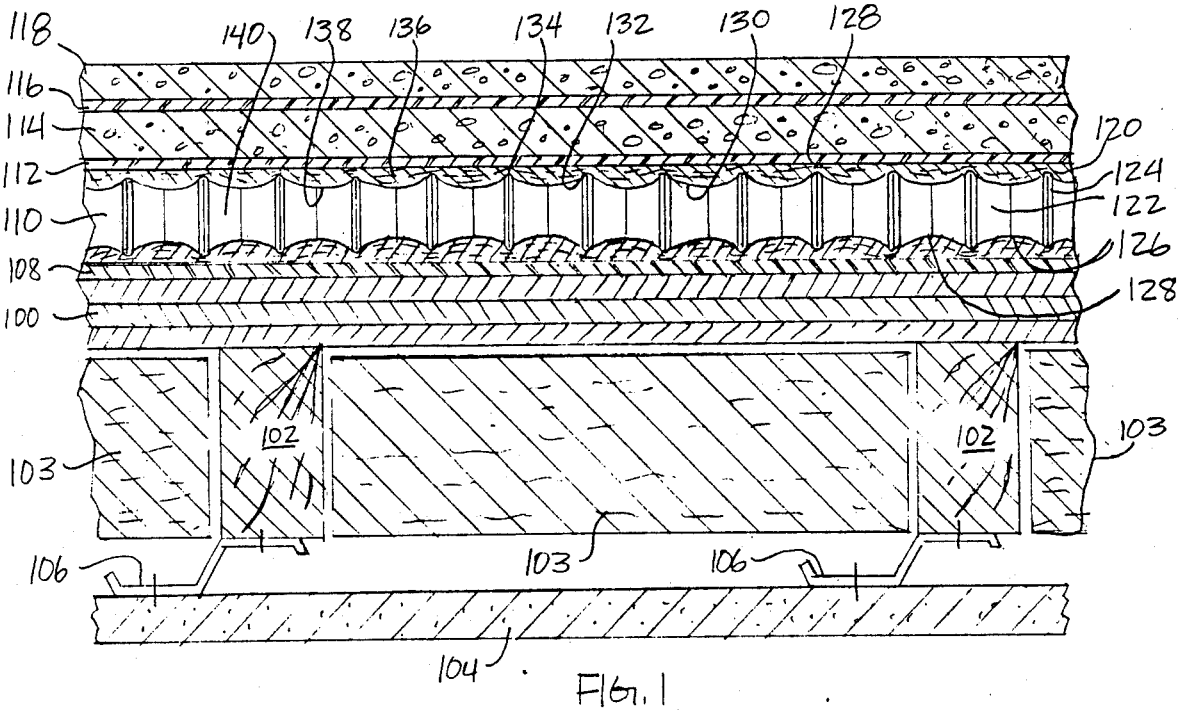
FIG. 1 is a cross-sectional view of a first embodiment of a sound rated floor system constructed in accordance with the present invention.

FIG. 1 discloses a preferred embodiment of the sound rated floor system of the present invention. In FIG. 1, a base substructure or subflooring 100 is fixed to cross members or joists 102, which provide rigid support for the subflooring 100. The subflooring 100 should be structurally sound, with deflection not exceeding 1/360 of the span, including live and dead loads. In the present embodiment, the subflooring comprises 2 or 3 layers of plywood nailed or glued to the joists 102. A ceiling 104 (optional) may be affixed to the bottom side of the joists 102 by means of resilient clips 106. Thermal/acoustical insulation means 103 may be placed above the ceiling 104 and below the subflooring 100 and also between the joists 102.

The attenuation layer 110 is placed or adhered above and directly on top of the subflooring. In the preferred embodiment, the attenuation layer 110 provides the acoustic isolation feature of the sound rated floor of the present invention.

The structure of the attenuation layer 110 is described fully in U.S. Pat. No. 4,522,284 to Fearon et al. and is manufactured as a composite panel structure by Peabody Noise Control, Inc., Dublin, Ohio. Acoustical panel 110 preferably includes a first facing 120 of semi-resilient material, preferably a fibrous material such as fiberglass with a higher density or hardened outer surface with lower density pillow-like portions extending into the cellular cores. The facing 120 is bonded directly to a cellular core 122, which is preferably a walled structure such as a honeycomb formed of cardboard, kraft paper, aluminum or similar material. In a particularly preferred embodiment, expandable hexagonal cells having walls 124 of kraft paper comprise the cellular core 122. A second facing 126 of semi-resilient material similar to the first facing 120 is bonded directly to the cellular core 122 to form the other side of acoustical panel 110.

The facings 120 and 126 are essentially planar along their outer surfaces 128 but extend inward as convex pillows 130 so as to partially fill the cells of the core 122. The facings 120 and 126, initially formed as an uncured blanket of relatively uniform thickness and density, are formed during the manufacture of the acoustical panel 110 into a quilt-like configuration. The facings 120 and 126 form valleys or channels 132 for receiving the walls 124 and corresponding thin portions 134 between the walls 124 and the outer surfaces 128. Less dense, acoustically semi-transparent portions 136 remain between the channels 132, and soft inner surfaces 138 extend into the cells formed by the walls 124.

The attenuation layer provides control of both airborne noise to provide a high degree of sound transmission loss and structure-borne noise to provide a high degree of impact noise insulation, such as caused by pedestrian footfall.

The core thickness and spacing of the walls 124 may be varied to permit tuning of the acoustical structure to a particular absorption frequency range. Generally, an increase in the volume of the cells results in a lower tuned absorption frequency. As a result of the combined sound absorption of the facings 120 and 126 and the entrapped air spaces 140 of the core 122, the acoustical panel 110 exhibits better sound absorption over a broader frequency range than homogeneous fiberglass of a comparable thickness. Furthermore, the acoustical panel 110 exhibits better sound absorption than a corresponding honeycomb core layup having fiberglass facings of relatively uniform thickness bonded to the core by conventional methods.

The unique construction of the Peabody composite panel structure preferred here as the attenuation layer results in a system which is relatively stiff to imposed static loads to prevent cracking of the overlying grout and tile but which is relatively soft when exposed to dynamic or impact loads due to the venting of the increased air pressure caused by the impact through the valving effect of the fiberglass into the cores of the honeycomb.

The preferred attenuation layer for use in the present invention has a perpendicular distance from the relatively hard outer surface of the first facing to the relatively hard outer surface of the second surface of the second facing of equal to or less than approximately $\frac{5}{8}$ inch, with the diameter of the cells being equal to or less than approximately $\frac{1}{2}$ inch. Also, other forms of composite panel structure, such as those described in U.S. Pat. No. 4,522,284, can be used in the sound rated floor of the present invention. For example, an attenuation layer having a septum in the center of the core or a panel having a first facing, an interlayer interposed between a core, and a second facing could also be used as well for greater thickness depending upon construction requirements.

After the attenuation layer, the next layer in the preferred embodiment may be an optional moisture inhibiting layer 112, preferably a membrane placed directly on and above the attenuation layer.

The next layer, which is placed directly on top of the moisture inhibiting layer or membrane 112, is a rigid layer 114 for supporting the finished covering to avoid cracking. This rigid layer 114 preferably comprises glass reinforced concrete boards, such as the concrete glass fiber reinforced construction panel manufactured by Modulars, Inc. of Hamilton, Ohio and sold under the trademark "Wonderboard". Wonderboard is available in a thickness of 7/16 inch at a weight of approximately 3.5 pounds per square foot. A similar cement board is marketed under the trademark "Flexboard" by the Johns-Manville Company. In addition, another concrete panel is marketed under the trademark "Ultraboard Regular" by Brit-Am Venture Marketing Limited of Middlesex, N.J. This is an inorganic cementitious board available in thicknesses from 3/16 inch to $\frac{1}{2}$ inch and in panel sizes of 8 and 10 feet by 4 feet in width.

The next layer, placed directly on top of the glass reinforced concrete boards, is a grout or thin set adhesive layer 116. The finished covering 118, such as ceramic tile, is then placed on top of the grout layer 116.

In an alternative embodiment, where the finished covering is to be a hardwood finish or vinyl tile instead of a ceramic tile finish, the rigid layer 114 may be constructed by two or three layers of plywood substituted for the glass reinforced concrete boards. The hardwood finished covering is then bonded or nailed to the plywood to complete the sound rated floor system.

Figure 2:
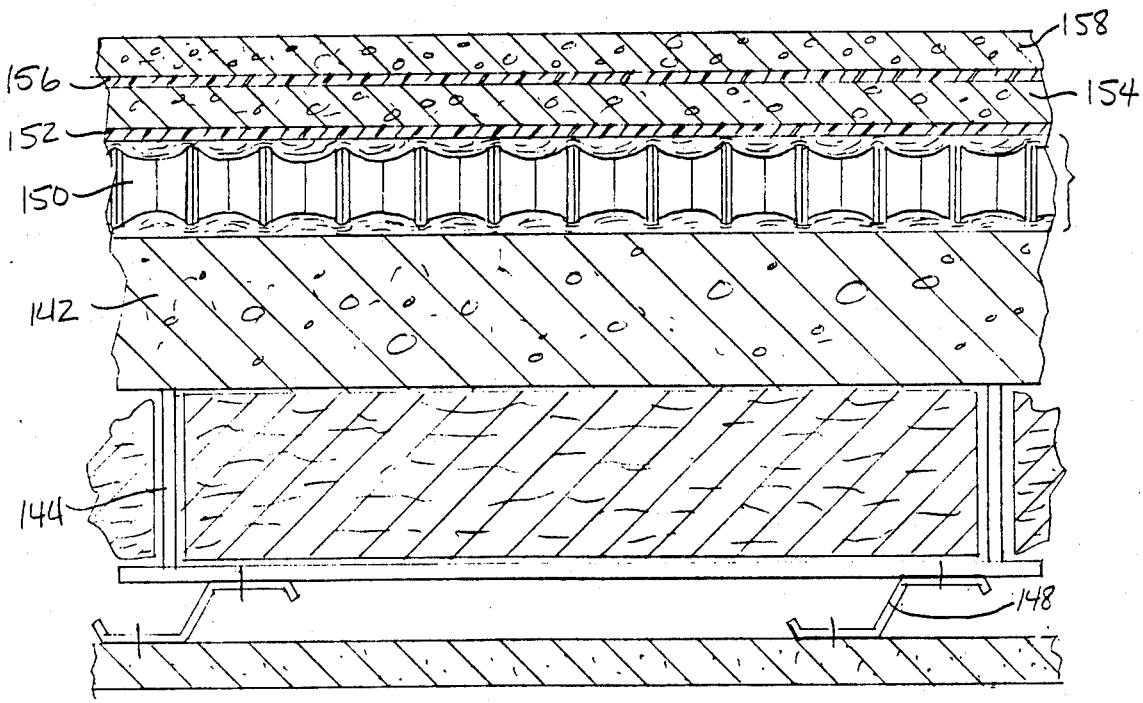
FIG. 2 is a cross-sectional view of a second embodiment of a sound rated floor system constructed in accordance with the present invention.

Another preferred embodiment, similar in many respects to FIG. 1, is shown in FIG. 2. In FIG. 2, a base surface or subflooring 142 comprises precast concrete or poured concrete over an appropriate supporting or floor joist structure 144, which can also support an optional ceiling 146 below on resilient clips 148. An acoustical panel 150 similar to the panel 110 described above with respect to FIG. 1 is placed directly on top of the concrete subflooring 142. An optional moisture inhibiting layer 152, such as a membrane, is then placed on top of panel 150. A rigid layer 154 is next, such as glass reinforced concrete boards, followed by an adhesive layer 156 and the finished flooring 158.

Figure 3:
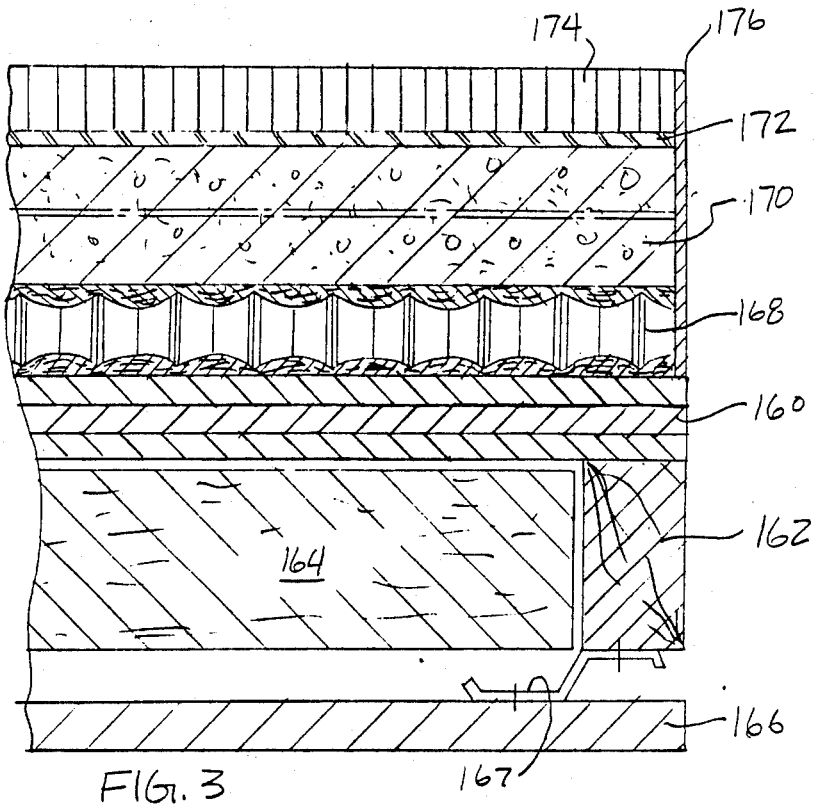
FIG. 3 is a cross-sectional view of a third embodiment of a sound rated floor constructed in accordance with the present invention.

FIG. 3 shows yet a third embodiment of the present invention. Subflooring 160 comprising three layers of plywood is secured to joists indicated as 162. Gypsum board, ASTM C36 Type and $\frac{5}{8}$ inch thick, forms ceiling 166 held on by resilient clips 167, and insulation material 164 is laid between the subflooring 160 and ceiling 166. The Peabody composite panel structure 168 is placed above subflooring 160, and a reinforced mortar bed 170 is laid down next. A bond coat 172 comprising dry-set mortar or latex portland cement mortar is placed next, on top of which is the finished covering of ceramic tile 174. An elastomeric or acoustical sealant 176 can be placed around the perimeter.

Figure 4:
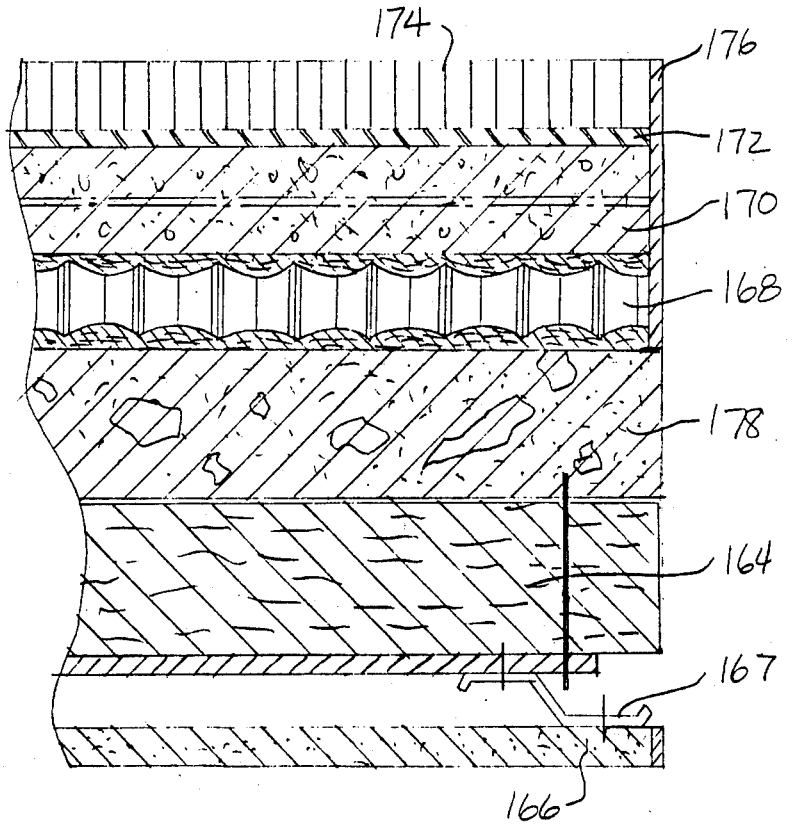
FIG. 4 is a cross-sectional view of a fourth embodiment of a sound rated floor constructed in accordance with the present invention.

FIG. 4 presents yet a fourth alternative embodiment substantially like that shown in FIG. 3, except primarily that a concrete subflooring 178 is used.

Figure 5:
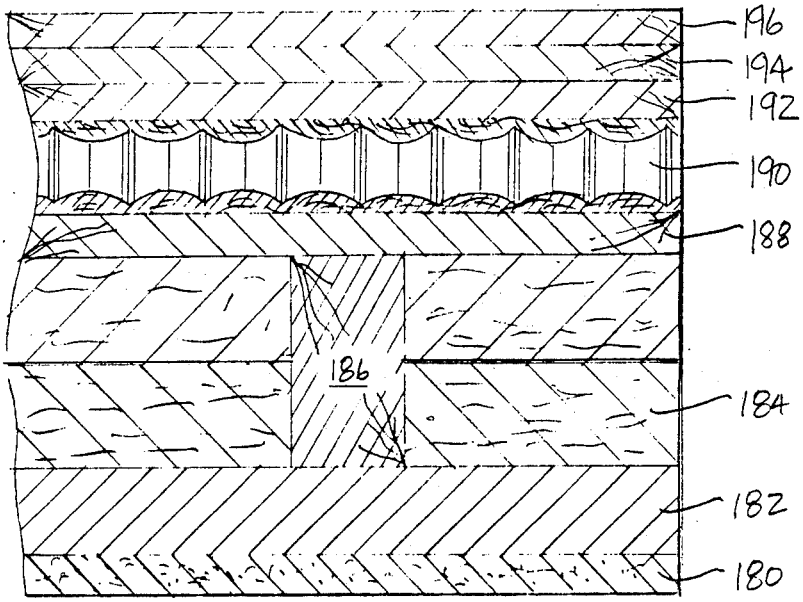
FIG. 5 is a cross-sectional view of a fifth embodiment of a sound rated floor constructed in accordance with the present invention.

FIG. 5 presents yet a fifth alternative embodiment. In this embodiment, joists 186 support wooden sleepers 182 and a gypsum board or plaster ceiling 180 below. A plywood or other wooden subfloor 188 is on top, with fiberglass bats 184 in between subflooring 188 and sleepers 182. The Peabody $\frac{5}{8}$ inch thick molded fiberglass honeycomb composite forms the sound attenuation layer 190, upon which is placed two layers 192 and 194 of plywood, the second layer 194 being cross lapped. The finished covering 196, such as hardwood, vinyl tile, or other hard floor finish then goes on top.

Use of the acoustic panel disclosed herein as the noise attenuation layer or isolation medium provides better performance than the isolation mediums of the prior art with respect to the important characteristics of noise attenuation, rigidity, and thickness. The ideal isolation medium would provide good noise attenuation with sufficient rigidity to support a tile floor without cracking, while at the same time would have minimal thickness to provide for a minimum transition between the floor and adjacent carpeted areas. Before the acoustic panel of this invention was used as an isolation medium, the prior art taught that a relatively soft isolation medium was necessary to inhibit the transmission of noise through the isolation medium. However softness or lack of rigidity in the isolation medium caused difficulties in maintaining a sufficiently rigid surface for the finished cover to avoid cracking problems. To increase rigidity and attenuation required an undesirable increase in thickness.

The acoustical panel of the present invention is rigid enough at relatively small thicknesses to provide adequate support for the finished covering, but at the same time imparts better noise attenuation properties to a sound rated floor than does the prior art material.

It should be understood that various changes and modifications to the preferred embodiment described above will be apparent to those skilled in the art. Such changes and modifications can be made without departing from the spirit and scope of the present invention, and it is therefore intended that such changes and modifications be covered by the following claims.

We claim:

1. An acoustic isolating medium adapted to be positioned intermediate a subflooring and a finished flooring to provide a sound-rated flooring, said isolating medium comprising:

(a) a sound attenuation layer comprising
  (i) a core having wall means forming cells open to at least one side of the core; and
  (ii) at least one acoustically semi-transparent first facing of fibrous material and a binder formed to provide a relatively hard outer surface, the first facing being bonded to said first side of the core; and (b) a rigid layer positioned above the sound attenuation layer and comprising means for supporting the finished flooring in a substantially rigid fashion, whereby a sound-rated flooring is provided in which the finished flooring is substantially acoustically isolated from the subflooring.

2. The acoustic isolating medium of claim 1, further comprising:

(a) a first moisture inhibiting layer positioned under the sound attenuation layer; and (b) a second moisture inhibiting layer positioned between the sound attenuation layer and the rigid layer.

3. An acoustic isolating medium adapted to be positioned intermediate a subflooring and finished flooring to provide a sound-rated flooring, said isolating medium comprising:

(a) a composite panel structure comprising
  (i) a core having wall means forming cells open to a first side and a second side thereof;
  (ii) an acoustically semi-transparent first facing of fibrous material and a binder formed to provide a first relatively hard outer surface, the first facing being bonded to the wall means on said first side of the core; and
  (iii) an acoustically semi-transparent second facing of fibrous material and a binder formed to provide a second relatively hard outer surface, the second facing being bonded to the wall means on said second side of the core; and (b) a rigid layer for positioning in a substantially horizontal plane above said composite panel structure, said rigid layer comprising means for supporting the finished flooring in a substantially rigid manner, whereby a sound-rated flooring is provided in which the finished flooring is substantially acoustically isolated from the subflooring.

4. The acoustic isolating medium of claim 3, wherein the rigid layer comprises reinforced concrete.

5. The acoustic isolating medium of claim 3, wherein the rigid layer comprises an approximate $1\frac{1}{4}$ inch thick cement mortar board bed.

6. The acoustic isolating medium of claim 3, wherein the rigid layer comprises wood or plywood.

7. The acoustic isolating medium of claim 3, further comprising a moisture inhibiting barrier for positioning between said composite panel structure and said rigid layer, said moisture inhibiting layer comprising means for inhibiting the passage of moisture therethrough.

8. The acoustic isolating medium of claim 7, wherein the moisture inhibiting barrier comprises a membrane.

9. The acoustic isolating medium of claim 3, wherein the wall means comprises a paper honeycomb core and said first and second facings comprise fiberglass.

10. The acoustic isolating medium of claim 9, wherein the perpendicular distance from the first relatively hard outer surface of the first facing to the second relatively hard outer surface of the second facing is approximately in the range ½ inch to 2 inches inclusive.

11. The acoustic isolating medium of claim 10, wherein the diameter of the cells is equal to or less than approximately ½ inch.

12. An acoustic isolating medium adapted to be positioned intermediate a subflooring and finished flooring to provide a sound-rated flooring, said isolating medium comprising:

(a) a sound attenuation layer comprising a composite panel structure having acoustical absorbing properties, comprising
  (i) a core having wall means forming cells open to at least one side of the core;
  (ii) at least one acoustically semi-transparent and semi-resilient first facing of fibrous material and a binder molded to provide a relatively hard, higher density outer surface and a relatively soft, lower density inner surface protruding into the cells of the core; and
(b) a rigid layer positioned above the sound attenuation layer and comprising means for supporting the finished flooring in a substantially rigid fashion, whereby a sound-rated flooring is provided in which the finished flooring is substantially acoustically isolated from the subflooring.

13. An acoustic isolating medium adapted to be positioned intermediate a subflooring and finished flooring to provide a sound-rated flooring, said isolating medium comprising:

(a) a composite panel structure for positioning in a substantially horizontal plane above said subflooring, said structure comprising
  (i) a core having wall means forming cells open to a first side and a second side thereof;
  (ii) an acoustically semi-transparent and semi-resilient first facing of fibrous material and a binder molded to provide a first relatively hard, higher density outer surface and a relatively soft, lower density inner surface protruding into the cells of the core;
  (iii) an acoustically semi-transparent and semi-resilient second facing of fibrous material and a binder molded to provide a second relatively hard, higher density outer surface and a relatively soft, lower density inner surface protruding into the cells of the core, the second facing being positioned on said second side of the core with either said first or second outer surface being positioned adjacent to said subflooring; and
(b) a rigid layer for positioning in a substantially horizontal plane above said composite panel structure, said rigid layer comprising means for supporting the finished flooring in a substantially rigid manner, whereby a sound-rated flooring is provided, in which the finished flooring is substantially acoustically isolated from the subflooring.

14. A sound rated flooring comprising:

(a) a subflooring;
(b) a sound attenuation layer for resting on the subflooring, said attenuation layer comprising
  (i) a core having wall means forming cells open to at least one side of the core; and
  (ii) at least one acoustically semi-transparent first facing of fibrous material and a binder formed to provide a relatively hard outer surface, the first facing being bonded to said first side of the core;
(c) a rigid layer positioned on the sound attenuation layer and comprising substantially rigid support means; and
(d) a finished flooring for being supported on said rigid layer.

15. The flooring of claim 14, further comprising:

(a) a first moisture inhibiting layer positioned between the subflooring and the sound attenuation layer; and
(b) a second moisture inhibiting layer positioned between the sound attenuation layer and the rigid layer.

16. A sound-rated flooring comprising:

(a) a base surface;
(b) a composite panel structure for positioning in a substantially horizontal plane above said base surface, said structure comprising
  (i) a core having wall means forming cells open to a first side and a second side thereof;
  (ii) an acoustically semi-transparent first facing of fibrous material and a binder formed to provide a first relatively hard outer surface, the first facing being bonded to the wall means on said first side of the core; and
  (iii) an acoustically semi-transparent second facing of fibrous material and a binder formed to provide a second relatively hard outer surface, the second facing being bonded to the wall means on said second side of the core with either said first or second outer surface being positioned adjacent to said base surface;
(c) a rigid layer for positioning in a substantially horizontal plane above said composite panel structure, said rigid layer comprising substantially rigid support means; and
(d) a finished covering for being supported on said rigid layer.

17. The flooring of claim 16, wherein the rigid layer comprises reinforced concrete.

18. The flooring of claim 16, wherein the rigid layer comprises an approximate 1¼ inch thick cement mortar board bed.

19. The flooring of claim 16, wherein the rigid layer comprises wood or plywood.

20. The flooring of claim 16, further comprising a moisture inhibiting barrier for positioning between said composite panel structure and said rigid layer, said moisture inhibiting layer comprising means for inhibiting the passage of moisture therethrough.

21. The flooring of claim 20, wherein the moisture inhibiting barrier comprises a membrane.

22. The flooring of claim 16, wherein the wall means comprises a paper honeycomb core and said first and second facings comprise fiberglass.

23. The flooring of claim 22, wherein the perpendicular distance from the first relatively hard outer surface of the first facing to the second relatively hard outer surface of the second facing is approximately in the range $\frac{1}{2}$ inch to 2 inches inclusive.

24. The flooring of claim 23, wherein the diameter of the cells is equal to or less than approximately $\frac{1}{2}$ inch.

25. A method for constructing a sound-rated floor to support a finished covering over a base surface, the method comprising:

(a) positioning a composite panel structure above said base surface in a substantially horizontal plane, said structure comprising
  (i) a core having wall means forming cells open to a first side and a second side thereof;
  (ii) an acoustically semi-transparent first facing of fibrous material and a binder molded to provide a first relatively hard, higher density outer surface and a relatively soft, lower density inner surface protruding into the cells of the core;
  (iii) an acoustically semi-transparent second facing of fibrous material and a binder molded to provide a second relatively hard, higher density outer surface and a relatively soft, lower density inner surface protruding into the cells of the core, the second facing being positioned on said second side of the core with either said first or second outer surface being positioned adjacent to said base surface; and (b) positioning a rigid layer above said composite panel structure in a substantially horizontal plane, said rigid layer comprising means for supporting a finished covering in a substantially rigid manner.

26. The method of claim 25, further comprising the step of positioning means for inhibiting the passage of moisture between said composite panel structure and said rigid layer.

27. A method for constructing a sound rated flooring, the method comprising:

(a) laying down a subflooring;

(b) positioning a composite panel structure above said subflooring in a substantially horizontal plane, said structure comprising
  (i) a core having wall means forming cells open to a first side and a second side thereof;
  (ii) an acoustically semi-transparent first facing of fibrous material and a binder molded to provide a first relatively hard, higher density outer surface and a relatively soft, lower density inner surface protruding into the cells of the core;
  (iii) an acoustically semi-transparent second facing of fibrous material and a binder molded to provide a second relatively hard, higher density outer surface and a relatively soft, lower density inner surface protruding into the cells of the core, the second facing being positioned on said second side of the core with either said first or second outer surface being positioned adjacent to said subflooring;

(c) positioning a rigid layer above said composite panel structure in a substantially horizontal plane, said rigid layer comprising means for supporting a finished flooring in a substantially rigid manner; and (d) laying down a finished flooring on said rigid layer.

28. The method of claim 27, further comprising the step of positioning means for inhibiting the passage of moisture between said composite panel structure and said rigid layer.

29. The method of claim 28, wherein said subflooring comprises plywood and said rigid layer comprises reinforced concrete.

* * * * *